United States Patent [19]

Seavey

[11] Patent Number: 4,779,759

[45] Date of Patent: Oct. 25, 1988

[54] TAMPER PREVENTION DISPENSERS

[76] Inventor: Alfred H. Seavey, 7215 Sellers Ave., Upper Darby, Pa. 19082

[21] Appl. No.: 9,492

[22] Filed: Feb. 2, 1987

[51] Int. Cl.[4] ..... G07T 11/16

[52] U.S. Cl. ..... 221/232; 221/307; 221/154; 221/281

[58] Field of Search ..... 221/232, 268, 281, 307, 221/154

[56] References Cited

U.S. PATENT DOCUMENTS

| | | | |
|---|---|---|---|
| 609,017 | 8/1898 | Foss | 221/232 |
| 1,088,949 | 3/1914 | Warren | 221/232 |
| 1,155,688 | 10/1915 | Shearman et al. | 221/232 |
| 2,074,674 | 3/1937 | Sedjian | 221/307 |
| 2,591,855 | 4/1952 | Nicholson | 221/232 |
| 2,824,666 | 2/1958 | Hausladen | 221/232 |
| 2,833,028 | 5/1958 | Treiman | 221/232 |
| 2,946,482 | 7/1960 | Johnson | 221/268 |
| 3,393,831 | 7/1968 | Stewart | 221/268 |
| 3,578,207 | 5/1971 | Danow | 221/232 |

FOREIGN PATENT DOCUMENTS

| | | | |
|---|---|---|---|
| 216740 | 6/1924 | United Kingdom | 221/232 |

*Primary Examiner*—H. Grant Skaggs
*Attorney, Agent, or Firm*—Leon Gilden

[57] ABSTRACT

Boxes and bottles of pills and other medications are factory sealed in a tamper proof dispenser which permits the dispensing of only one bottle or box at a time. Once removed from the tamper proof container, a bottle or box cannot be repositioned in the container, while spring means are utilized to permit the singular dispensing of each bottle or box from the container.

1 Claim, 3 Drawing Sheets

TAMPER PREVENTION DISPENSERS

BACKGROUND OF THE INVENTION

1. Field of the Invention

The present invention relates to tamper proof containers, and more particularly pertains to a new and improved tamper proof dispensing apparatus which facilitates the singular dispensing of medication containers.

2. Description of the Prior Art

In recent years, there has been a considerable amount of publicity regarding tampering with medicament containers on store shelves. In a number of cases such containers have had their contents poisoned and have then been resealed and replaced on store shelves for distribution to the public. As the result of several deaths, a large interest has developed towards the manufacture of medicament containers which are substantially tamper proof. These tamper proof containers are designed to be either substantially difficult to open or to provide an indication to a purchaser that such an undesired opening has occurred. It appears that all such efforts at tamper proofing medicament containers has centered around the sealing of the containers per se, and no efforts have been expended towards developing larger tamper proof dispensers which would protectively retain and dispense the smaller medicament containers.

With respect to the construction of dispensers now known in the prior art which might be adapted for use as a tamper proof container dispensers, a number of such dispensers have been developed wherein the contents thereof are normally inaccessible until dispensed by some type of spring biasing means. For example, reference is made to U.S. Pat. No. 926,316, which issued to A. Cairns on June 29, 1909. The Cairns device comprises a match box having a plurality of matches contained therein with such matches being dispensable one at a time by means of a manually operable spring ejection mechanism. Those matches not ejected are otherwise inaccessible. Another patent of interest is U.S. Pat. No. 2,960,259, which issued to A. Aveni on Nov. 15, 1960. The dispenser shown in this patent utilizes spring means to effect the ejectment of pills, one at a time, from a dispenser with the pills remaining therein being substantially inaccessible. However, the construction of the dispenser is complex and accordingly, it would most likely be too expensive to commercially manufacture and market.

U.S. Pat. No. 3,724,715, which issued to N. Auriemma on Apr. 3, 1973, discloses a larger scale dispenser designed to retain and individually dispense a plurality of material holding containers. Spring means are utilized to eject the material holding containers, one at a time, and an expanding crown device flexibly holds and guides a container as it is removed from the dispenser system. However, the construction of this assembly is also substantially complex and is not designed in a tamper proof manner.

Accordingly, it can be appreciated that there exists a continuing need for new and improved tamper proof dispensing systems which may be easily and inexpensively manufactured and which would reliably permit dispensing of medicament containers to the consuming public. In this respect, the present invention substantially fulfills this need.

SUMMARY OF THE INVENTION

In view of the foregoing disadvantages inherent in the known types of tamper proof dispensers now present in the prior art, the present invention provides an improved tamper proof dispensing construction wherein a plurality of non-tamper proof medicament containers or the like can be contained therein in a tamper proof manner and can be selectively dispensed to the consuming public as needed. As such, the general purpose of the present invention, which will be described subsequently in greater detail, is to provide a new and improved tamper proof dispensing assembly which has all the advantages of the prior art tamper proof dispensing assemblies and none of the disadvantages.

To attain this, the present invention is directed to the construction of a factory sealed container in which a plurality of non-tamper proof material holding boxes or bottles may be retained. A spring biasing means facilitates a positioning of a single box or bottle proximate a dispensing slot formed in the container, and a manually actuable mechanism than permits the singular dispensing of such a box or bottle from the container when desired. Immediately upon the dispensing of a box or bottle from the container, the spring means moves another box or bottle into the dispensing slot position so as to prevent the reinsertion of the removed unit. As such, once a unit is removed from the tamper proof dispenser it cannot be reinserted therein. Accordingly, the consuming public is cautioned to purchase only those material holding containers which have not yet been removed from the primary dispensing assembly. The embodiments of the invention can be constructed to hole either boxes or bottles, as desired, and can be either totally factory sealed, so as to be disposed of after all bottles or boxes contained therein have been removed, or a lockable lid assembly can be provided to allow a refilling of the main container as needed.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, method and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tamper proof dispenser which has all the advantages of the prior art tamper proof dispensers and none of the disadvantages.

It is another object of the present invention to provide a new and improved tamper proof dispenser which may be easily and efficiently manufactured and marketed.

It is a further object of the present invention to provide a new and improved tamper proof dispenser which is of a durable and reliable construction.

An even further object of the present invention is to provide a new and improved tamper proof dispenser which is susceptible of a low cost of manufacture with regard to both materials and labor, and which accordingly is then susceptible of low prices of sale to the consuming public, thereby making such tamper proof dispensers economically available to the buying public.

Still yet another object of the present invention is to provide a new and improved tamper proof dispenser which provides in the apparatuses and methods of the prior art some of the advantages thereof, while simultaneously overcoming some of the disadvantages normally associated therewith.

Still another object of the present invention is to provide a new and improved tamper proof dispenser which eliminates the need for providing specialized tamper proof arrangements on marketable material holding containers.

Yet another object of the present invention is to provide a new and improved tamper proof dispenser which substantially promotes the safe dispensing of medicaments and other materials to the consuming public.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. such description makes reference to the annexed drawings wherein.

DESCRIPTION OF THE PREFERRED EMBODIMENTS

Figure 1:
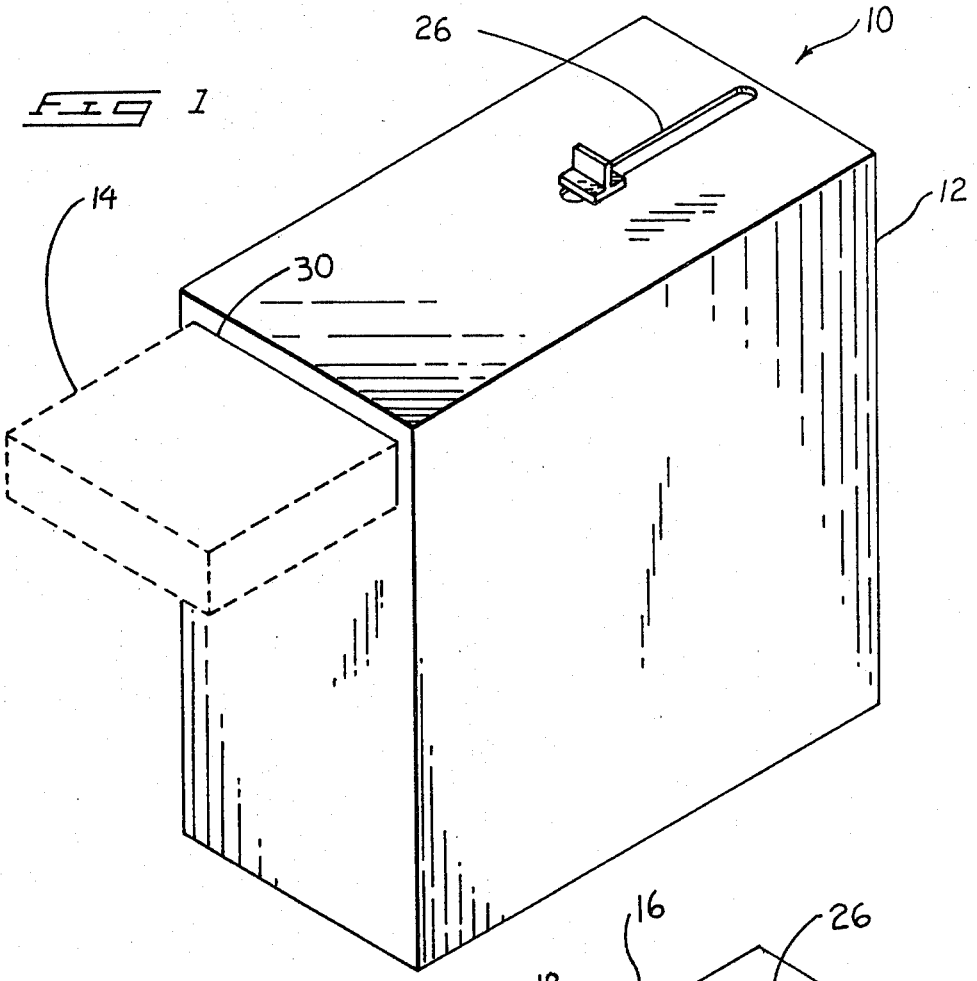
FIG. 1 is a perspective view of a first embodiment of tamper proof dispenser comprising the present invention.
Figure 2:
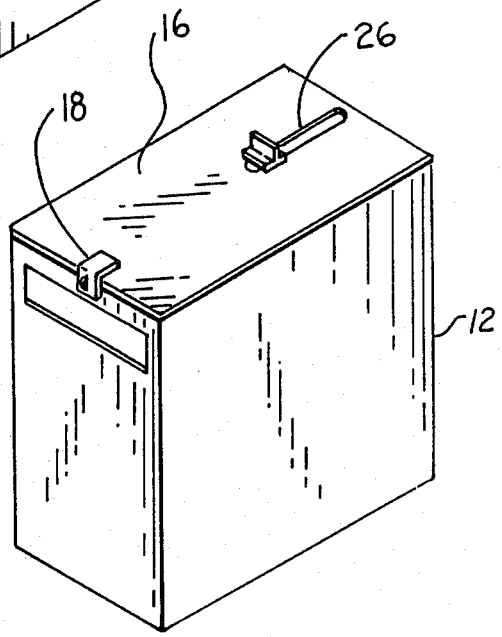
FIG. 2 is a perspective view of a slightly modified form of the first embodiment of the invention.

With reference now to the drawings, and in particular to FIGS. 1 and 2 thereof, a new and improved tamper proof dispenser embodying the principles and concepts of the present invention and generally designated by the reference numeral 10 will be described.

More specifically, it will be noted that the dispenser 10, in a first embodiment thereof, may essentially comprise a completely sealed rectangularly-shaped contained 12 in which a plurality of material holding containers 14 may be retained. As shown in FIG. 1, the container 12 may be of a factory sealed construction so as to be unopenable and unrefillable with containers 14. FIG. 2 illustrates an embodiment of the invention wherein it is provided with a topmost hingedly connected lid 16 so as to permit a refilling thereof with medicaments or other material holding containers 14 as needed. In this modified form of the invention, the lid 16 may be provided with a conventional locking clasp 18 in which an unillustrated lock may be inserted to prevent entry thereinto by unauthorized individuals.

Figure 3:
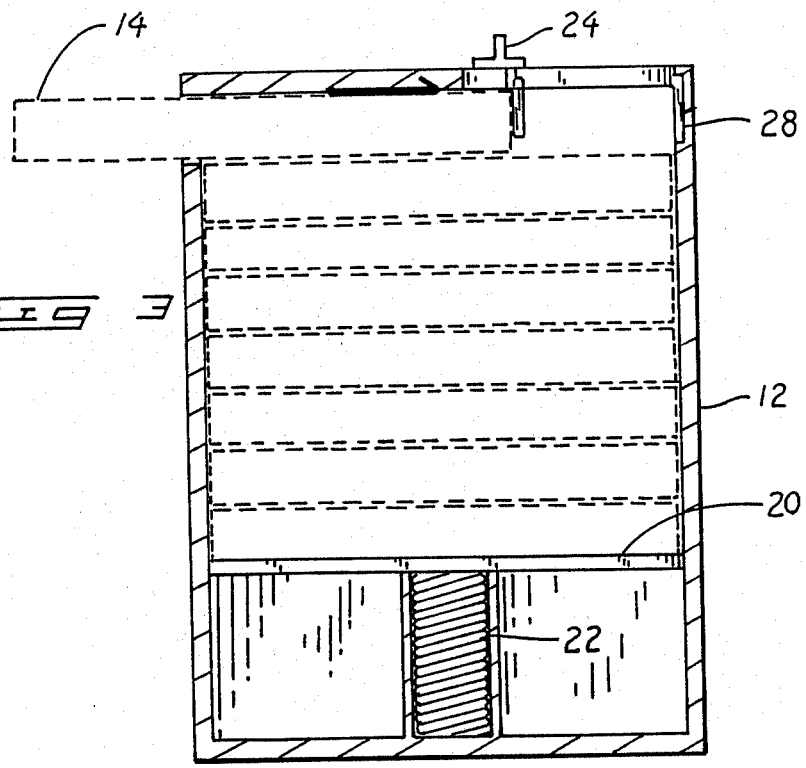
FIG. 3 is a side elevation view, partly in cross section, illustrating the internal operable components of the first embodiment of the invention.

Referencing FIG. 3 in conjunction with FIGS. 1 and 2, it will be observed that a plurality of the material holding containers 14 may be stacked within an interior portion of the container 12 so as to be dispensable one at a time from the dispenser. The stacked containers 14 are positioned on a movable plate 20 which is disposed in a slidable manner within the dispenser 12, and a compressible helical spring 22 serves to move the plate 20 upwardly within the dispenser as the containers 14 are removed.

A manually operable ejectment lever 24 is slidably disposed within a slot 26. As shown, the lever 24 may be retained within a recess 28 when not being utilized so as to not prevent an upward movement of the stacked containers 14. An ejectment of an individual material holding container 14 can be accomplished through a forward movement of the lever 24 within the slot 26, as best illustrated in FIG. 3, and a return of the lever to the recess 28 then allows a further container 14 to move upwardly into position so as to be dispensable through a ejectment slot 30 formed in the dispenser 12.

Figure 5:
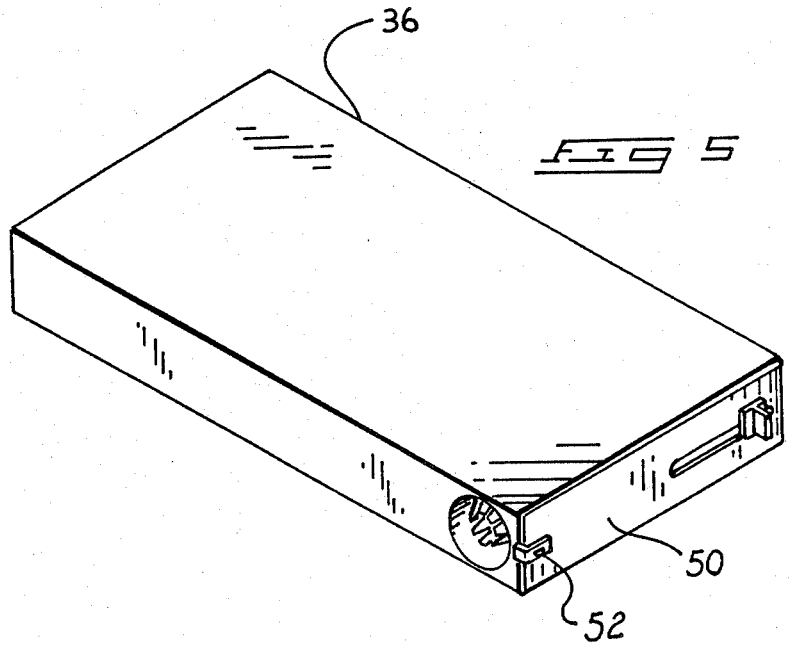
FIG. 5 is a perspective view of a slightly modified form of the second embodiment of the invention.
Figure 4:
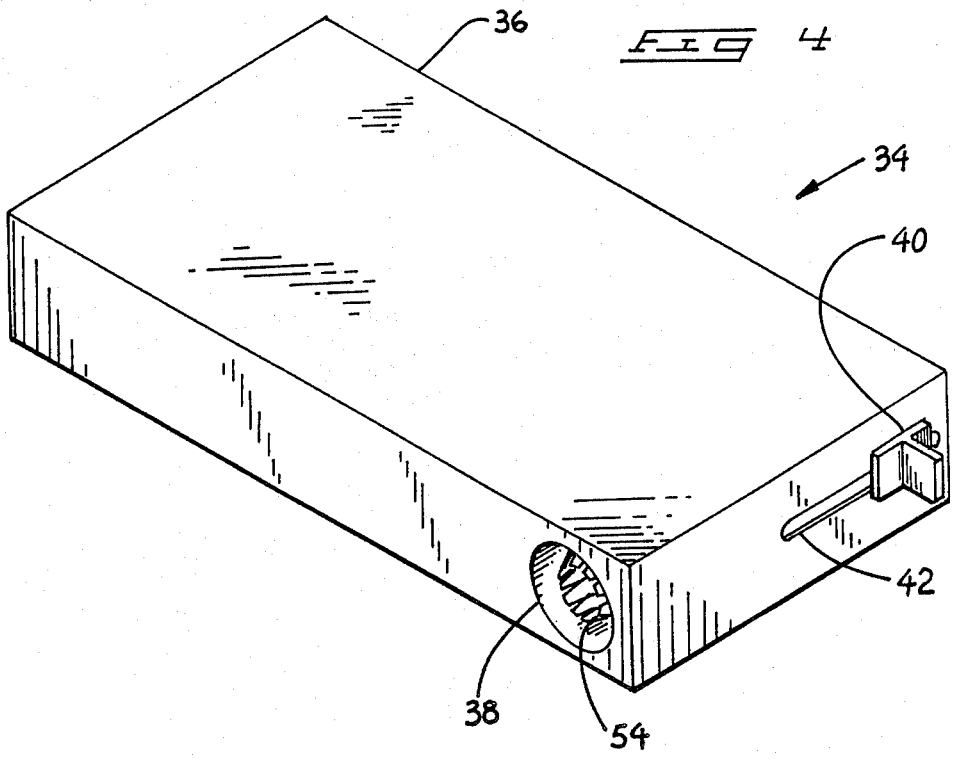
FIG. 4 is a perspective view of a second embodiment of the invention.
Figure 6:
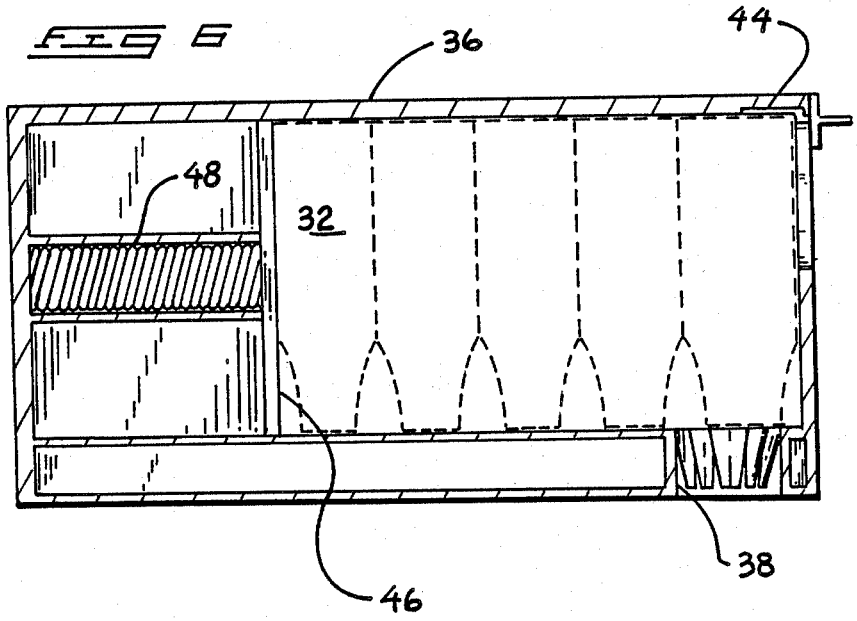
FIG. 6 is a side elevation view, partly in cross section, illustrating the internal construction of the second embodiment of the invention.

FIGS. 4, 5 and 6 illustrate a modified embodiment of the invention which is particularly designed for the holding and dispensing of material holding bottles 32. In this respect, this modified embodiment of the invention which is generally designated by the reference numeral 34 may also be formed as a rectangularly shaped container 36 and can include an inaccessible ejectment slot 38 formed therein. A manually actuatable lever 40 is movable within a slot 42 to effect an ejectment of a bottle 32 through the opening 38, with this lever being retained in a recess 44 formed on an interior surface of the container 36. The bottles 32 are moved upwardly towards the ejectment slot 38 by a slidable plate 46. The plate 46 is moved upwardly within the dispenser 36 by a compressed helical spring 48 in a manner similar to that illustrated with respect to the first embodiment 10 of the invention.

As shown in FIG. 5, the dispenser 36 may be provided with a hingedly connected openable lid 50 having a conventional locking clasp 52 attached thereto, thereby to allow a refilling of the dispenser when needed, or alternatively, as shown in FIG. 4, a totally sealed construction may be provided. In this latter construction, the dispenser 36 would be factory sealed and would be discarded after all of the material holding bottles 32 have been dispensed therefrom. To further facilitate the tamper proof construction of the invention, a flexible expansible crown member 54 may be fixedly secured within the opening 38. The crown member 54 would flexibly open to allow a bottle 32 to be dispensed therefrom, while preventing undesired access to an interior portion of the dispenser 36 or a reinsertion of a bottle.

As to the manner of operation and usage of the various embodiments of the invention, the same should be apparent from the above description. Accordingly, no further discussion with respect to the manner of usage and operation will be provided. In summary, it can be appreciated that a consumer should only purchase material holding containers 14, 32 after removing them from their respective dispensers 12, 36, and any such containers which have already been removed from the dispenser should be avoided inasmuch as they could have been tampered with.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved tamper proof dispenser for holding and selectively dispensing a plurality of material holding containers, said dispenser comprising:

sealable housing means for holding said material holding containers in a tamper proof manner:

cylindrical opening means formed in said sealable housing means on a first wall proximate a first end of said housing means said cylindrical opening means serving as a means for permitting endwise removal of said containers from said housing means, and a conical resilient crown means positioned in surrounding relationship to said opening means for limiting access interiorly of said housing means for exteriorly thereof; said crown means formed of resiliently expandable finger elements permitting one way passage of said containers therethrough and said elements tapering from said opening to a further opening defined by terminal ends of said finger elements, said terminal ends of said finger elements further defining an area less than that of said opening when said finger elements are in a non-expanded orientation relative to each other, and spring biasing means secured interiorly of said housing means at a second end of said housing means remote from said cylindrical opening means for operably moving said containers, one at a time, into a dispensing position proximate said opening means: and manually operable lever means for selectively permitting a dispensing of said containers, one at a time, through said cylindrical opening means so as to be removable from said housing means, said lever means slideably mounted on said housing means for reciprocating motion parallel to an axis of said cylindrical opening means and wherein said manually operable lever means is retained within a recess formed in an interior wall portion of said housing means, thereby to prevent interference between said lever means and said material holding containers as said containers are moved in position proximate said opening means; and where said sealable housing means includes a tamper-proof lockable lid assembly including a clasp for accepting a tamper-proof separate lock member for facilitating a refilling of said housing means with said material holding containers, said lid assembly including a lid hingedly secured to said housing means adjacent said cylindrical opening means on a second wall opposite to and parallel said first wall and said lid slidably receiving said lever means, and further including plate means positionable within said housing means and beneath said containers, said plate means being movable by said spring biasing means wherein said spring biasing means comprises a compressible helical spring, and said helical spring is positionable between said plate means and a bottom floor surface of said housing means

* * * * *